US005824464A

United States Patent [19]

Schell et al.

[11] Patent Number: 5,824,464

[45] Date of Patent: Oct. 20, 1998

[54] PHOTOGRAPHIC ELEMENT WITH IMPROVED DRYING CHARACTERISTICS

[75] Inventors: Brian A. Schell, Honeoye Falls; Michael W. Orem, Rochester; Yongcai Wang, Penfield, all of N.Y.

[73] Assignee: Eastman Kodak Company, Rochester, N.Y.

[21] Appl. No.: 932,597

[22] Filed: Sep. 17, 1997

[51] Int. Cl.[6] ..... G03C 1/89; G03C 1/795; G03C 1/76

[52] U.S. Cl. ..... 430/533; 430/531; 430/536; 430/637; 430/961

[58] Field of Search ..... 430/531, 637, 430/961, 533, 536

[56] References Cited

U.S. PATENT DOCUMENTS

| | | | |
|---|---|---|---|
| 2,627,088 | 2/1953 | Alles et al. | 18/47.5 |
| 2,698,235 | 3/1954 | Swindells | 430/535 |
| 2,698,240 | 12/1954 | Westfield et al. | 430/535 |
| 2,943,937 | 6/1960 | Nadeau et al. | 430/535 |
| 3,018,272 | 1/1962 | Griffing et al. | 260/75 |
| 3,143,421 | 8/1964 | Nadeau et al. | 430/535 |
| 3,201,249 | 8/1965 | Pierce et al. | 430/514 |
| 3,271,178 | 9/1966 | Nadeau et al. | 430/535 |
| 3,501,301 | 3/1970 | Nadeau et al. | 430/535 |
| 3,929,489 | 12/1975 | Arcesi et al. | 430/302 |
| 4,307,174 | 12/1981 | Noonan et al. | 430/215 |
| 4,419,437 | 12/1983 | Noonan et al. | 430/631 |
| 4,497,917 | 2/1985 | Upson et al. | 523/201 |
| 4,612,279 | 9/1986 | Steklenski et al. | 430/531 |
| 4,735,976 | 4/1988 | Steklenski et al. | 524/32 |
| 4,879,291 | 11/1989 | Bannasiak et al. | 514/237.8 |
| 4,880,867 | 11/1989 | Gobel et al. | 524/507 |
| 4,954,559 | 9/1990 | Den Hartog et al. | 524/507 |
| 5,006,413 | 4/1991 | Den Hartog et al. | 428/463 |
| 5,129,916 | 7/1992 | Buonafede | 606/201 |
| 5,166,254 | 11/1992 | Nickle et al. | 524/512 |
| 5,204,404 | 4/1993 | Werner et al. | 524/501 |
| 5,366,855 | 11/1994 | Anderson et al. | 430/527 |
| 5,446,205 | 8/1995 | Marchionni et al. | 568/603 |
| 5,447,832 | 9/1995 | Wang et al. | 430/523 |

*Primary Examiner*—Richard L. Schilling
*Attorney, Agent, or Firm*—Carl F. Ruoff

[57] ABSTRACT

The present invention is a photographic element which includes a support having a front surface and a back surface, and a silver halide imaging layer superposed on the front side of the support. A backing layer is superposed on the backside of the support and is formed by the coating and subsequent drying of an aqueous coating composition having therein a mixture of film-forming colloidal particles and non-film-forming colloidal particles and a fluoropolyether comprising more than 90 mole % units selected from the group consisting of $—CF_2—CF_2—O—$, $—CF_2—O—$, $—CF(CF_3)—O—$, and $—CF_2—CF(CF_3)—O—$, and a functional group selected from the group consisting of COOH, $—CH_2—OH$, $—CH_2—COOH$, $—CH_2—SO_3H$, $—CH_2—PO_3H$, $—(CH_2—CH_2—O)—H$, and $—(CH_2—CH(CH_3)—O—)—H$.

12 Claims, No Drawings

PHOTOGRAPHIC ELEMENT WITH IMPROVED DRYING CHARACTERISTICS

CROSS REFERENCE TO RELATED APPLICATIONS

This application relates to commonly assigned copending application Ser. No. 08/932,014, filed simultaneously herewith and hereby incorporated by reference for all that it discloses.

FIELD OF THE INVENTION

This invention relates to an aqueous coatable backing layer for photographic support materials with improved drying characteristics in photoprocessing equipment.

BACKGROUND OF THE INVENTION

Layers of imaging elements other than the imaging layer itself are often referred to as auxiliary layers. A typical auxiliary layer application is as a backing layer that provides resistance to scratches, abrasions, blocking, and ferrotyping. Backing layers for photographic applications must also be chemically impermeable to processing solutions when employed as barrier layers for an underlying antistatic layer in order to maintain post-process conductivity. Backing layers must provide the above chemical and physical properties when employed as very thin layers, typically less than one micron, making film formation and quality of critical importance. In addition, such layers must not adversely affect the sensitometric response of the imaging layer or reduce the transparency of the processed film.

Glassy, hydrophobic polymers such as polyacrylates, polymethacrylates, polystyrenics, or cellulose esters are often employed as backing layers for imaging elements because of their desirable chemical and physical properties. These are most often coated from organic solvent-based solutions. For example, U.S. Pat. Nos. 4,612,279 and 4,735,976 herein incorporated by reference, describe organic solvent-applied protective overcoats for antistatic layers comprising a blend of cellulosic nitrate and a copolymer containing acrylic or methacrylic acid.

Because of environmental considerations it is desirable to replace organic solvent-based coating formulations with water-based coating formulations. The challenge has been to develop water-based coatings that provide similar physical and chemical properties in the dried film to those obtained with organic-solvent based coatings.

Water insoluble polymer particles contained in aqueous latexes and dispersions reported to be useful for coatings on photographic films typically have low glass transition temperatures (Tg) to insure coalescence of the polymer particles into a strong, continuous film. Generally the Tg of such polymers is less than 50° C. Typically these polymers are used in priming or "subbing" layers which are applied onto the film support to act as adhesion promoting layers for photographic emulsion layers. Such low Tg polymers, although useful when they underlay an emulsion layer, are not suitable as, for example, backing layers since their blocking and ferrotyping resistance is poor. To fully coalesce a polymer latex which has a higher Tg requires significant concentrations of coalescing aids. This is undesirable for several reasons. Volatilization of the coalescing aid as the coating dries is not desirable from an environmental standpoint. In addition, subsequent recondensation of the coalescing aid in the cooler areas of the coating machine may cause coating imperfections and conveyance problems. Coalescing aid that remains permanently in the dried coating will plasticize the polymer and adversely affect its resistance to blocking, ferrotyping, and abrasion.

An approach reported to provide aqueous coatings that require little or no coalescing aid is to use core-shell latex polymer particles. A soft (low Tg) shell allows the polymer particle to coalesce and a hard (high Tg) core provides the desirable physical properties. The core-shell polymers are prepared in a two-stage emulsion polymerization process. The polymerization method is non-trivial and heterogeneous particles that contain the soft polymer infused into the hard polymer, rather than a true core-shell structure, may result (Journal of Applied Polymer Science, Vol. 39, page 2121, 1990). Aqueous coating compositions comprising core-shell latex polymer particles and use of such coalescing aid-free compositions as ferrotyping resistant layers in photographic elements are disclosed in Upson and Kestner U.S. Pat. No. 4,497,917 herein incorporated by reference. The polymers are described as having a core with a Tg of greater than 70° C. and a shell with a Tg from 25° to 60° C.

An alternative approach reported for aqueous paint and sealant compositions containing little or no coalescing aid involves utilizing a formulation that comprises a mixture of two dispersed polymers having different Tg values. Typically, the soft, low Tg polymer comprises the major fraction of the blend and the hard polymer has a Tg less than 45° C. Therefore, these compositions would not be suitable as ferrotyping resistant coatings for photographic elements. For example, U.S. Pat. No. 4,897,291 herein incorporated by reference, describes an aqueous formulation useful as a wood sealant that comprises a soft polymer with a Tg of −70° to 5° C. and an optional second polymer with a Tg of 5° to 40° C.

Aqueous coating compositions containing a binder material comprising a mixture of 90 to 40 weight % of acrylic latex containing hydroxyl groups, 10 to 60 weight % polyurethane dispersion, and pigments useful as a top coat for automobiles are described in U.S. Pat. No. 4,880,867. U.S. Pat. Nos. 4,954,559 and 5,006,413 herein incorporated by reference, describe aqueous coating compositions for automobile finishes containing 10 to 30 weight % solids that comprise 60 to 90 weight % of methylol(meth)acrylamide acrylic polymer latex having a Tg of −40° to 40° C. and 10 to 40 weight % of a polyurethane dispersion. The use of these compositions in imaging applications was not disclosed.

U.S. Pat. Nos. 5,166,254 and 5,129,916 herein incorporated by reference, describe a water-based coating composition containing mixtures of an acrylic latex, and an acrylic hydrosol. The acrylic latex contains 1 to 15% of methylol (meth)acrylamide, 0.5 to 10% carboxylic acid containing monomer, and 0.5 to 10% hydroxyl containing monomer, and has a Tg of from −40° to 40° C. and a molecular weight of from 500,000 to 3,000,000. U.S. Pat. No. 5,204,404 herein incorporated by reference, describes a water-based coating composition containing a mixture of a dispersed acrylic silane polymer and a polyurethane. The acrylic silane polymer is prepared by emulsion polymerization and contains 1 to 10% of silane containing acrylates, 0.1 to 10% of carboxylic acid containing monomer, and 2 to 10% of hydroxyl containing monomer. The polymer has a Tg of from −40° to 25° C. and a molecular weight of from 500,000 to 3,000,000.

There are several differences in designing aqueous coating compositions for imaging applications from those for paint and automobile finishes. One difference is in the drying time cycle. Long drying time cycles can insure that polymer particles contained in a coating composition have sufficient time to pack and deform to from a continuous, void-free film. In interior and exterior paint applications the drying time is of the order of hours or days. In automobile finish applications the drying time lasts at least 10 to 30 minutes. However, in imaging element manufacture the drying time for coatings is typically less than one minute. Often the drying time is as brief as 30 seconds. Therefore, an aqueous coating composition, which is effective for paint and automobile finish applications, may not be suitable for imaging applications. Under the temperatures and, especially, the residence times employed during the coating and drying of coatings on photographic films, polymer particles with Tg as low as 30° C. may require the addition of high boiling point organic solvent coalescing aids to promote the formation of void-free continuous films.

U.S. Pat. Nos. 5,447,832 and 5,366,855 herein incorporated by reference, describe a coalesced layer for imaging elements comprising a mixture of film-forming colloidal polymer particles, including polyurethane dispersions, and non-film forming colloidal polymer particles. Those layers are coated from aqueous media and contain polymer particles of both high and low glass transition temperatures. Typically, the film forming colloidal polymer particles consist of low Tg polymers, and are present in the coated layers from 20 to 70 percent by weight. Though the layers obtained from these mixed polymer particles possess the mechanical attributes required of a photographic backing layer, they are deficient in one respect, as are layers resulting from coatings of water dispersible or water soluble polymers. The presence of hydrophilic groups and/or surfactants which is necessary to disperse or solubilize these polymers causes the final dried layer to be aggressively wetted by aqueous processing solutions. This can result in drying problems in photoprocessing equipment, particularly in processors with limited drying capacity, as excess solution adheres to the backing layer as film exits the processor, causing sticking between laps of the take-up spool. It is therefore an objective of the present invention to provide an aqueous coating composition with the excellent physical properties and manufacturability of the '832 and '855 patents while having improved drying characteristics in processing equipment, as reflected in a higher contact angle when measured against processing solutions.

SUMMARY OF THE INVENTION

The present invention is a photographic element which includes a support having a front surface and a back surface, and a silver halide imaging layer superposed on the front side of the support. A backing layer is superposed on the backside of the support and is formed by the coating and subsequent drying of an aqueous coating composition having therein a mixture of film-forming colloidal particles and non-film-forming colloidal particles and a fluoropolyether comprising more than 90 mole % units selected from the group consisting of $—CF_2—CF_2—O—$, $—CF_2—O—$, $—CF(CF_3)—O—$, and $—CF_2—CF(CF_3)—O—$, and a functional group selected from the group consisting of COOH, $—CH_2—OH$, $—CH_2—COOH$, $—CH_2—SO_3H$, $—CH_2—PO_3H$, $—(CH_2—CH_2—O)—H$, and $—(CH_2—CH(CH_3)—O—)—H$.

The backing layer obtained from the coating composition of the invention has an increased contact angle against photographic processing solutions while maintaining a high coefficient of friction, resulting in improved drying in photoprocessing equipment without adversely effecting transport.

DETAILED DESCRIPTION OF THE INVENTION

The present invention relates to a photographic element comprising a support, at least one light-sensitive layer, and a protective overcoat or backing layer. The backing layer is obtained by coating and drying an aqueous coating composition comprising a mixture of film-forming polymeric particles and non-film-forming polymeric particles and a fluoropolyether.

The support material may comprise various polymeric films, such as, cellulose esters including cellulose diacetate, cellulose triacetate, cellulose acetate butyrate, cellulose propionate, paper, glass, and the like, polyester support such as polyethylene terephthalate, polyethylene naphthalate, polycarbonate, polystyrene, polyacrylates, polyolefins, such as, polyethylene polypropylene, etc. Polyesters are preferred. The thickness of the support is not critical. Support thicknesses of 50 $\mu$m to 254 $\mu$m (2 to 10 mil) can be employed, for example, with very satisfactory results. The polyester support typically employs an undercoat or primer layer between the antistatic layer and the polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178; and 3,501,301 herein incorporated by reference.

The backing layer in accordance with this invention is applied from a coating composition comprising a continuous aqueous phase having dispersed therein a mixture of film-forming colloidal polymer particles and non-film-forming colloidal polymer particles which are described in the previously mentioned U.S. Pat. Nos. 5,447,832 and 5,366,855.

Coating compositions for preparing layers in accordance with the invention comprise a continuous aqueous phase having dispersed therein a mixture of film-forming polymeric particles (component A) and non-film-forming polymeric particles (component B) and a fluoropolyether. In the layers Component A comprises 20 to 70% of the total weight of components A and B of the coating composition. Other additional compounds may be added to the coating composition, depending on the function of the particular layer, including surfactants, emulsifiers, coating aids, matte particles, rheology modifiers, crosslinking agents, inorganic fillers such as metal oxide particles, pigments, magnetic particles, biocides and the like. The coating composition may also include small amounts of organic solvents, preferably the concentration of organic solvent is less than 1 weight % of the total coating composition.

The non-film-forming polymer (B) comprises glassy polymers that provide resistance to blocking, ferrotyping, abrasion and scratches. Non-film-forming polymer B is present in the coating composition and in the photographic layer in an amount of from 30 to 80 and preferably from 50 to 70 percent based on the total weight of film-forming polymer (A) and non-film-forming polymer (B). These polymers include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other polymers that may comprise component B include water-dispersible condensation polymers such as polyesters, polyurethanes, polyamides, and epoxies. Polymers suitable for component B do not give transparent, continuous films upon drying under conditions typical of photographic film support manufacturing processes.

The film-forming polymer (A) comprises polymers that form a continuous film under the extremely fast drying conditions typical of the photographic film manufacturing process. Polymers that are suitable for component A include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, crosslinking and graft-linking monomers such as 1,4-butyleneglycol methacrylate, trimethylolpropane triacrylate, allyl methacrylate, diallyl phthalate, divinyl benzene, and the like may be used. Other suitable polymers useful as component A are film-forming dispersions of polyurethanes or polyesterionomers.

The colloidal polymeric particles can be prepared either by emulsion polymerization or by emulsifying pre-formed polymers in water with a proper dispersing agent. In both cases, chain transfer agents including mercaptans, polymercaptans, and halogen compounds can be used in the polymerization mixture to moderate the polymer molecular weight. The weight average molecular weight of prepared polymers may vary from 5,000 to 30,000,000 and preferably from 50,000 to 10,000,000.

Preparation of polyurethane dispersions is well-known in the art and involves chain extending an aqueous dispersion of a prepolymer containing terminal isocyanate groups by reaction with a diamine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion.

The term polyesterionomer refers to polyesters that contain at least one ionic moiety. Such ionic moieties function to make the polymer water dispersible. These polyesters are prepared by reacting one or more dicarboxylic acids or their functional equivalents such as anhydrides, diesters, or diacid halides with one or more diols in melt phase polycondensation techniques as described in U.S. Pat. Nos. 3,018,272; 3,929,489; 4,307,174; 4,419,437, incorporated herein by reference. Examples of this class of polymers include, for example, Eastman AQ polyesterionomers, manufactured by Eastman Chemical Co.

Typically the ionic moiety is provided by some of the dicarboxylic acid repeat units, the remainder of the dicarboxylic acid repeat units are nonionic in nature. Such ionic moieties can be anionic or cationic, but, anionic moieties are preferred for the present invention. Preferably, the ionic dicarboxylic acid contains a sulfonic acid group or its metal salt. Examples include the sodium, lithium, or potassium salt of sulfoterephthalic acid, sulfonaphthalene dicarboxylic acid, sulfophthalic acid, and sulfoisophthalic acid or their functional equivalent anhydride, diester, or diacid halide. Most preferably the ionic dicarboxylic acid repeat unit is provided by 5-sodiosulfoisophthalic acid or dimethyl 5-sodiosulfoisophthalate.

The nonionic dicarboxylic acid repeat units are provided by dicarboxylic acids or their functional equivalents represented by the formula:

$$-\overset{\overset{\displaystyle O}{\|}}{C}-R-\overset{\overset{\displaystyle O}{\|}}{C}-$$

where R is an aromatic or aliphatic hydrocarbon or contains both aromatic and aliphatic hydrocarbons. Exemplary compounds include isophthalic acid, terephthalic acid, succinic acid, adipic acid, and others.

Suitable diols are represented by the formula: HO—R—OH, where R is aromatic or aliphatic or contains both aromatic and aliphatic hydrocarbons. Preferably the diol includes one or more of the following: ethylene glycol, diethylene glycol, or 1,4-cyclohexanedimethanol.

The polyesterionomer dispersions comprise from about 1 to about 25 mol %, based on the total moles of dicarboxylic acid repeat units, of the ionic dicarboxylic acid repeat units. The polyesterionomers have a glass transition temperature (Tg) of about 60° C. or less to allow the formation of a continuous film.

The film-forming polymeric particles, the non-film-forming polymeric particles or both type particles may include reactive functional groups capable of forming covalent bonds by intermolecular crosslinking or by reaction with a crosslinking agent (i.e., a hardener). Suitable reactive functional groups include: hydroxyl, carboxyl, carbodiimide, epoxide, aziridine, vinyl sulfone, sulfinic acid, active methylene, amino, amide, allyl, and the like.

The fluoropolyethers useful for the practice of the invention include those comprising more than 90 mole % unites selected from: $—CF_2—CF_2—O—$, $—CF_2— O—$, $—CF(CF_3)—O—$, and $—CF_2—CF(CF_3)—O—$, and a functional group selected from: COOH, $—CH_2—OH$, $—CH_2—COOH$, $—CH_2—SO_3H$, —CH2-$PO_3H$, $—(CH_2—CH_2—O)—H$, and $—(CH_2—CH(CH_3)—O—)—H$. The fluoroether segment provides the protective overcoat with good water repellent properties, and the functional group allows the compound to be readily dispersed in the aqueous phase and remain anchored to the protective overcoat surface through different treatment processes and during application. Such compounds can be made by processes as described in U.S. Pat. No. 5,446,205 herein incorporated by reference, and preferably have a molecular weight of about 300 to 5000. These fluoropolyether compounds are, for example, Fomblin MF series manufactured by Ausimount Inc. including Fomblin MF 201, Fomblin MF 402, Fomblin MF 403, and Fomblin MF 300, and Fluorolink series including Fluorolink C, Fluorolink D, Fluorolink E, and Fluorolink T. Preferably, the fluoropolyether compounds are carboxylic acid terminated perfluoropolyethers such as, for example, Fomblin MF 300 and Fluorolink C. The actual application amount of the fluoropolyether is about 0.01 to 10 parts by weight per 100 parts by weight of the total dry coating, preferably about 0.05 parts to 5 parts by weight per 100 parts by weight of the total dry coating, and most preferably about 0.1 parts to 2 parts by weight per 100 parts by weight of the total dry coating.

The coating composition of the present invention may also include a water soluble fluorine-containing surfactant, which acts as a coating aid in the prevention of repellencies and other coating defects, as well as a synergist when used in combination with the fluoropolyether to further raise the contact angle of the layer as measured against processing solutions. Fluorine-containing surfactants which are preferably used in the present invention include compounds having a perfluoroalkyl or perfluoroalkenyl group which has at least 6 carbon atoms, and which have, as the water soluble group, an anionic group, a cationic group, a betaine group, or a nonionic group. Examples of the fluorine-containing surfactants include, for example, Fluorad FC series manufactured by 3M Company, Zonyl series manufactured by E. I. Du Pont De Nemours & Co., and Fluorotenside FT series manufactured by Bayer AG. The fluorine-containing surfactant is employed at levels typical of other surfactants employed in aqueous coatings, preferably at 0.01 to 0.2% by weight based on the total solution weight.

The coating compositions in accordance with the invention may also contain suitable crosslinking agents that may effectively be used in the coating compositions of the invention including aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, and zirconium sulfate, and the like. The crosslinking agents may react with functional groups present on either the film-forming polymers, the non-film-forming polymers or on both.

Matte particles well known in the art may be used in the coating composition of the invention, such matting agents have been described in Research Disclosure No.308119, published December 1989, pages 1008 to 1009. When polymeric matte particles are employed, the polymers may contain reactive functional groups capable of forming covalent bonds by intermolecular crosslinking or by reaction with a crosslinking agent (i.e., a hardener) in order to promote improved adherence to the film-forming and non-film-forming polymers of the invention. Suitable reactive functional groups include: hydroxyl, carboxyl, carbodiimide, epoxide, aziridine, vinyl sulfone, sulfinic acid, active methylene, amino, amide, allyl, and the like.

Any of the reactive functional groups of the polymers and any of the crosslinking agents described in U.S. Pat. No. 5,057,407 and the patents cited therein may be used in accordance with this invention.

The coating composition of the invention can be applied by any of a number of well-know techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in Research Disclosure No. 308119, Published December 1989, pages 1007 to 1008.

In a particularly preferred embodiment, the photographic elements of this invention are photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (including pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994 and Research Disclosure, Item 38957 September 1996 herein incorporated by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired. Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The invention will now be described in detail with reference to examples; however, the present invention should not be limited to these examples.

The examples demonstrate that the aqueous coating compositions of the present invention have an increased contact angle against processing solutions while maintaining a high coefficient of friction, resulting in improved drying in photoprocessing equipment without adversely effecting transport.

EXAMPLES

Backing layers are prepared by coating the compositions listed in Table 1 at a dry weight of 1000 mg/m$^2$ onto a subbed polyester support that has previously been coated with a Ag-doped vanadium pentoxide antistat layer. Example 1 has a backing layer coated from an organic solvent. Examples 2 to 7 have backing layers coated from water.

TABLE 1

| Example | Coating Composition |
|---|---|
| 1 (Comparative) | Solvent-coated Elvacite 2041[a] |
| 2 (Comparative) | Neorez R960[b]/P-1[c] 40:60 ratio, 5 wt % CX-100[b] |
| 3 (Invention) | Neorez R960/P-1 40:60 ratio, 5 wt % CX-100, 0.29 wt % MF-300[d] |
| 4 (invention) | Neorez R960/P-1 40:60 ratio, 5 wt % CX-100, 0.29 wt % MF-300 0.1 wt % FT-248[e] |
| 5 (Invention) | Neorez R960/P-1 40:60 ratio, 5 wt % CX-100, 0.5 wt % MP-300, 0.1 wt % FT-248 |
| 6 (Invention) | Neorez R960/P-1 40:60 ratio, 5 wt % CX-100, 1% Fomblin Fluorolink C[d] |
| 7 (Invention) | Neorez R960/P-1 40:60 ratio, 5 wt % CX-100, 1% Fomblin Fluorolink C, 0.05% FT-248 |

a. Elvacite 2041 polymethylmethacrylate resin is a product of E. I. duPont de Nemours & Co.

b. Neorez R960 polyurethane dispersion and CX100 polyaziridine are products of Zeneca Resins.

c. P-1 is a poly(methyl methacrylate-co-methacrylic acid) (97/3 weight ratio) latex particle having a mean size of about 80 nm.

d. Fomblin Fluorolink C and MF-300, carboxylic acid-functional perfluoropolyethers, are products of Ausimont USA, Inc. Fomblins were employed as the amine salts.

e. Pluorotenside FT-248, the tetraethylammonium salt of perfluorooctyl sulfonic acid, is a product of Bayer AG. % given is based upon total coating composition weight.

Examples 1, 2, 5, and 7 are sensitized with a black and white silver halide emulsion. Films are processed in a Kodak Microfilm Miniprocessor.

Advancing contact angles are measured on samples of the coated supports by the tilted plate method using a Rame—Hart Goniometer. The test liquid used is a wash solution from the Miniprocessor which has been seasoned by running Example 2 to its failure point. (The failure point is defined here as the footage of film that may be processed before the backside emerges from the processor wet.). The sensitized film is also evaluated for friction and Taber Abrasion as described in U.S. Pat. No. 5,447,832. Results are shown in Table 2.

TABLE 2

| Example | Advancing Contact Angle | Miniprocessor Runnability | Paper Clip Friction | Taber Abrasion (% Delta Haze) |
|---|---|---|---|---|
| 1 | 92 | 1000 feet | .4 | 8 |
| 2 | 48.5 | 350 feet | .39 | 8.7 |
| 3 | 63 | | | |
| 4 | 91 | | | |
| 5 | 112 | >1000[1] feet | .42 | 8 |
| 6 | 70 | | | |
| 7 | 91 | >1300[1] feet | .37 | 8.9 |

[1]The Miniprocessor test is terminated at these footages.

While comparative Example 2 has similar Taber and frictional properties to the solvent coated Example 1, its much lower contact angle results in limited processor runnability. In sharp contrast, addition of the fluoropolyether and fluorosurfactant—as in Examples 5 and 7—raises the contact angle to equal or exceed that of Example 1, and processability is improved beyond that of even the solvent-coated layer.

The invention has been described in detail with particular reference to certain preferred embodiments thereof, but it will be understood that variations and modifications can be effected within the spirit and scope of the invention.

What is claimed is:

1. A photographic element comprising;

a support having a front surface and a back surface;

a silver halide imaging layer superposed on the front surface of said support; and a backing layer superposed on the back surface of said support, said backing layer formed by coating and subsequent drying of a coating composition comprising an aqueous medium having therein a mixture of film-forming colloidal particles and non-film-forming colloidal particles and a fluoropolyether comprising more than 90 mole % units selected from the group consisting of —$CF_2$—$CF_2$—O—, —$CF_2$—O—, —CF($CF_3$)—O—, and —$CF_2$—CF($CF_3$)—O—, and a functional group selected from the group consisting of —COOH, —$CH_2$—OH, —$CH_2$—COOH, —$CH_2$—$SO_3$CH, —$CH_2$—$PO_3$H, —($CH_2$—$CH_2$—O)—H, and —($CH_2$—CH($CH_3$)—O—)—H.

2. The photographic element of claim 1 wherein the support comprises cellulose diacetate, cellulose triacetate, cellulose acetate butyrate, cellulose propionate, paper, glass, polyethylene terephthalate, polyethylene naphthalate, polycarbonate, polystyrene, polyacrylates, polyethylene and polypropylene.

3. The photographic element of claim 1 wherein the coating composition further comprises a water solublefluorine-containing surfactant.

4. The photographic element of claim 1 wherein the coating composition further comprises matte particles, crosslinking agents, inorganic fillers, pigments, magnetic particles and biocides.

5. The photographic element of claim 1 wherein the film-forming colloidal particles comprise addition-type polymers, interpolymers prepared from ethylenically unsaturated monomers, film-forming dispersions of polyurethanes and film-forming dispersions of polyesterionomers.

6. The photographic element of claim 1 wherein the non film-forming colloidal particles comprise addition-type polymers prepared from ethylenically unsaturated monomers, acrylates, methacrylates, styrenes, acrylonitrile, methacrylonitrile, vinyl acetates, vinyl ethers, vinyl halides, vinylidene halides, and olefins.

7. A photographic element comprising;

a support having a front surface and a back surface;

a silver halide imaging layer superposed on the front surface of said support; and a backing layer superposed on the back surface of said support comprising a mixture of film-forming colloidal particles and non-film-forming colloidal particles and a fluoropolyether comprising more than 90 mole % units selected from the group consisting of —$CF_2$—$CF_2$—O—, —$CF_2$—O—, —$CF(CF_3)$—O—, and —$CF_2$—$CF(CF_3)$—O—, and a functional group selected from the group consisting of —COOH, —$CH_2$—OH, —$CH_2$—COOH, —$CH_2$—$SO_3H$, —$CH_2$—$PO_3H$, —($CH_2$—$CH_2$—O)—H, and —($CH_2$—$CH(CH_3)$—O—)—H.

8. The photographic element of claim 7 wherein the support comprises cellulose diacetate, cellulose triacetate, cellulose acetate butyrate, cellulose propionate, paper, glass, polyethylene terephthalate, polyethylene naphthalate, polycarbonate, polystyrene, polyacrylates, polyethylene and polypropylene.

9. The photographic element of claim 7 wherein the coating composition further comprises a water solublefluorine-containing surfactant.

10. The photographic element of claim 7 wherein the coating composition further comprises matte particles, crosslinking agents, inorganic fillers, pigments, magnetic particles and biocides.

11. The photographic element of claim 7 wherein the film-forming polymeric particles comprise addition-type polymers, interpolymers prepared from ethylenically unsaturated monomers, film-forming dispersions of polyurethanes and film-forming dispersions of polyesterionomers.

12. The photographic element of claim 7 wherein the non film-forming polymeric particles comprise addition-type polymers prepared from ethylenically unsaturated monomers, acrylates, methacrylates, styrenes, acrylonitrile, methacrylonitrile, vinyl acetates, vinyl ethers, vinyl halides, vinylidene halides, and olefins.

* * * * *